US007527042B2

(12) United States Patent
Crary

(10) Patent No.: US 7,527,042 B2
(45) Date of Patent: May 5, 2009

(54) ELECTROSTATIC CHARGE CONTROL FOR IN-TANK FUEL MODULE COMPONENTS

(75) Inventor: Lynwood F. Crary, Preston, CT (US)

(73) Assignee: TI Group Automotive Systems, LLC, Warren, MI (US)

( * ) Notice: Subject to any disclaimer, the term of this patent is extended or adjusted under 35 U.S.C. 154(b) by 519 days.

(21) Appl. No.: 11/391,092

(22) Filed: Mar. 28, 2006

(65) Prior Publication Data

US 2006/0219318 A1 Oct. 5, 2006

Related U.S. Application Data

(60) Provisional application No. 60/668,313, filed on Apr. 5, 2005.

(51) Int. Cl.
*F02B 67/00* (2006.01)
*F02B 67/08* (2006.01)

(52) U.S. Cl. ..... 123/509; 123/198 D

(58) Field of Classification Search ..... 123/509, 123/497, 198 D, 446; 417/423.14, 423.2, 417/410.1; 137/565.16; 73/313, 305, 290 R
See application file for complete search history.

(56) References Cited

U.S. PATENT DOCUMENTS

| | | | | |
|---|---|---|---|---|
| 3,186,551 | A | 6/1965 | Dornauf | |
| 3,418,991 | A | 12/1968 | Shultz et al. | |
| 4,342,224 | A * | 8/1982 | Hara et al. | 73/290 R |
| 4,999,108 | A | 3/1991 | Koch et al. | |
| 5,076,920 | A | 12/1991 | Danowski et al. | |
| 5,164,879 | A | 11/1992 | Danowski et al. | |
| 5,195,494 | A | 3/1993 | Tuckey | |
| 5,547,330 | A | 8/1996 | Walimaa et al. | |
| 5,642,718 | A * | 7/1997 | Nakai et al. | 123/497 |
| 5,647,330 | A | 7/1997 | Sawert et al. | |
| 5,785,032 | A | 7/1998 | Yamashita et al. | |
| 6,099,726 | A | 8/2000 | Gembolis et al. | |
| 6,164,267 | A | 12/2000 | Okada et al. | |
| 6,168,713 | B1 | 1/2001 | Sekine et al. | |
| 6,206,035 | B1 | 3/2001 | Wehner et al. | |
| 6,216,671 | B1 | 4/2001 | Sawert et al. | |
| 6,220,227 | B1 | 4/2001 | Okada et al. | |
| 6,382,190 | B1 | 5/2002 | Tanabe et al. | |
| 6,435,163 | B1 | 8/2002 | Fauser et al. | |
| 6,453,870 | B1 | 9/2002 | Koller et al. | |
| 6,464,870 | B1 | 10/2002 | Castellanos et al. | |

(Continued)

FOREIGN PATENT DOCUMENTS

| | | | |
|---|---|---|---|
| JP | 8232792 | A | 9/1996 |

(Continued)

*Primary Examiner*—Mahmoud Gimie
(74) *Attorney, Agent, or Firm*—Leydig, Voit & Mayer, Ltd.

(57) ABSTRACT

A flange arrangement for a fuel module comprising a non-conductive flange member to connect the fuel module to a fuel tank includes tube posts that each connect to a conductive support tube, a conductive web in conductive contact with the support tubes and a conductive fuel supply port in conductive contact with the web. In one embodiment, the web and port are integral. In another, the web and port are separate parts. The flange arrangement is made of polymeric material and the web and port are overmolded into the flange.

34 Claims, 10 Drawing Sheets

U.S. PATENT DOCUMENTS

| | | | | |
|---|---|---|---|---|
| 6,613,227 | B2 | 9/2003 | Rickle | |
| 6,679,227 | B2 | 1/2004 | Sawert et al. | |
| 6,740,236 | B2 | 5/2004 | Rickle et al. | |
| 6,762,245 | B2 | 7/2004 | Bonnet et al. | |
| 6,802,301 | B2 | 10/2004 | Fauser et al. | |
| 6,877,373 | B2 | 4/2005 | Gilmour et al. | |
| 6,890,190 | B1 * | 5/2005 | Jurcak et al. | 439/92 |
| 7,185,682 | B2 * | 3/2007 | Riegel et al. | 141/97 |
| 2003/0131828 | A1 | 7/2003 | Crary | |
| 2006/0213486 | A1 * | 9/2006 | Powell et al. | 123/509 |

FOREIGN PATENT DOCUMENTS

| | | | |
|---|---|---|---|
| JP | 9032674 | A | 2/1997 |
| WO | WO 93/23665 | A1 | 11/1993 |

* cited by examiner

ELECTROSTATIC CHARGE CONTROL FOR IN-TANK FUEL MODULE COMPONENTS

This application claims the benefits under Title 35 USC §120 based on U.S. Provisional Application No. 60/668,313, filed on Apr. 5, 2005.

BACKGROUND OF THE INVENTION

Pending application for U.S. patent Ser. No. 10/441,213 discloses structure for providing an electrostatic discharge path to ground of various components within a vehicular in-tank fuel module.

The present invention similarly relates to in-tank fuel modules having components made of plastic or polymeric materials. More specifically, it relates to in-tank fuel modules arranged to prevent the accumulation of and provide for the safe dissipation of electrostatic charges that might be generated as a result of fuel flow.

The in-tank fuel module for a fuel tank of a vehicle or other device employing an internal combustion engine typically includes a plurality of separate components, such as a reservoir, a fuel pump and motor, fuel filter and housing, a pressure regulator and housing, an aspiration jet pump and the like. It can happen that such components are made of non-conductive materials or may include elements that are electrically conductive; but, the electrically conductive element is electrically insulated from the associated electrical circuit that defines a ground plane. For instance, the conductive component may be disposed within or mounted on a non-conductive body, that is, a component that lacks sufficient conductivity to create a path to dissipate an electrostatic charge.

Conductive, as well as non-conductive components of an in-tank fuel module are susceptible of accumulating an electrostatic charge. It is well known to employ an arrangement that provides for dissipation of such static charge to prevent excessive build-up. Various examples are described in U.S. Pat. Nos. 5,076,920; 5,647,330; 5,785,032; 6,047,685; 6,206,035 and 6,435,163.

As the investigation of electrostatic charge build-up in in-tank fuel modules proceeds, refinements in the overall scheme for protection evolve. The present invention results from this process. Not only does it recognize the advantage to be derived from implementing such protection in areas not previously considered significant, it also provides enhanced mechanisms for accomplishing an overall improvement in the protection afforded.

To control build-up of the electrostatic charge in the components of an in-tank fuel module, it is known in the art to electrically connect the component to the vehicle ground plane, usually to the negative terminal of the battery that defines that electrical plane.

DETAILED DESCRIPTION OF THE ILLUSTRATED EMBODIMENTS

Figure 1:
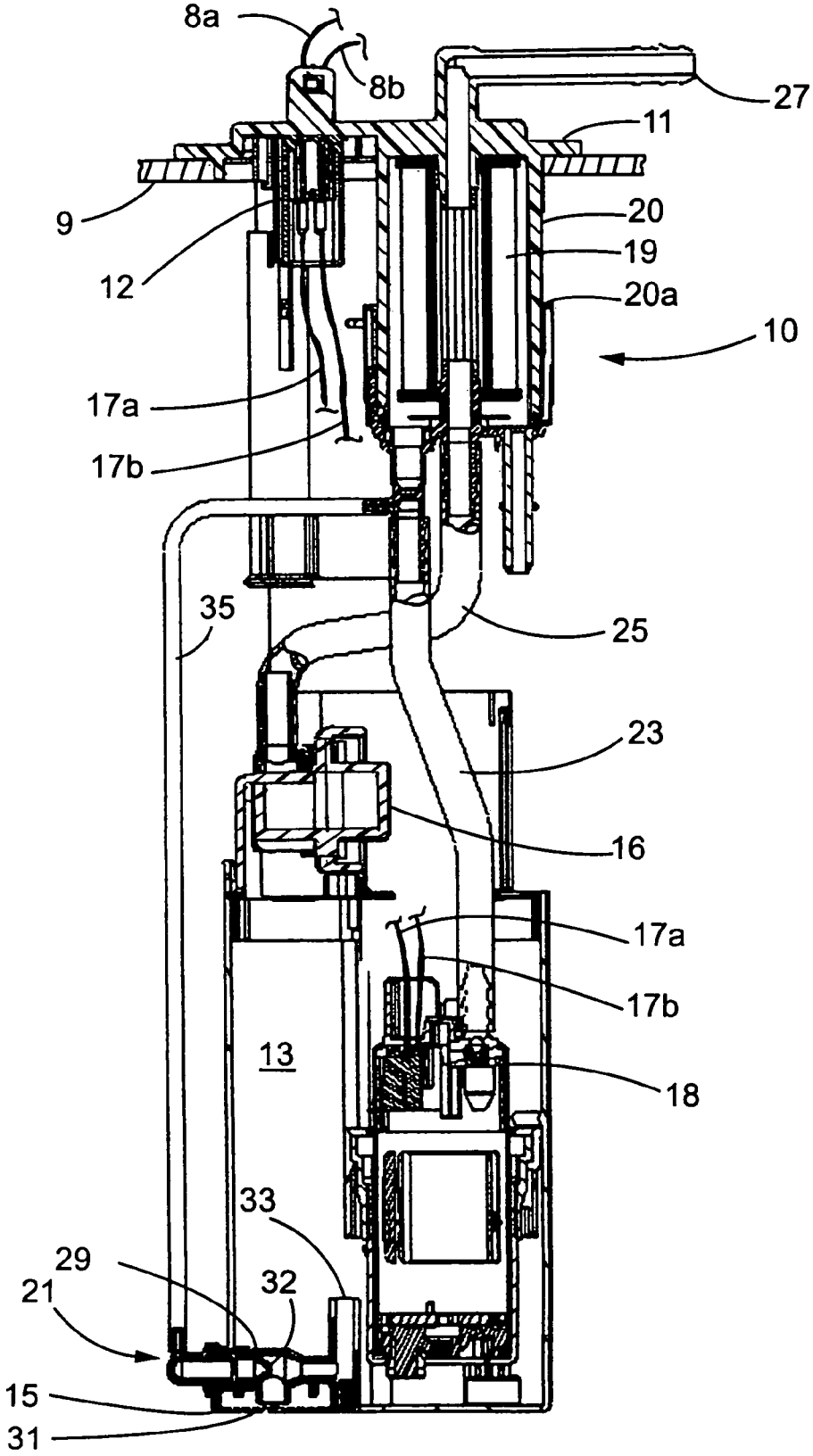
FIG. 1 is a front view, partially in cross section, and partially broken away, of an in-tank fuel module illustrating various principles of the present invention.

In the embodiment of FIG. 1, there is disclosed an in-tank fuel module 10 adapted to be positioned in a fuel tank 9 associated with an internal combustion engine. Though the main application of such an arrangement is for a vehicle, the invention has application to other apparatus powered by an internal combustion engine, such as a stationary or auxiliary power unit, engine driven pump or electric generator.

The module 10 includes a flange 11 connecting the module to fuel tank 9. The module further includes a fuel reservoir 13, a fuel pump and motor 18, a fuel filter housing 20 in which there is positioned a fuel filter 19, a fuel pressure regulator 16, and an aspiration jet pump 21. These components are connected by hoses 23 or 25. The module communicates fuel from the main tank 9 to the vehicle engine though the pump and motor 18 to the filter housing 20 for delivery to the engine through an outlet connector 27.

Flange 11 supports an electrical receptacle 12. It receives power from the electrical system associated with the engine. The electrical system includes leads 8*a* and 8*b* that plug into receptacle 12. One lead, 8*a*, represents the negative side of the battery of the electrical system and is considered representative of the system ground plane.

Fuel pump and motor 18 are supported in the reservoir 13. Power to the motor is supplied through electrical leads 17*a* and 17*b* connected to electrical receptacle 12. Lead 17*a* is connected to the negative lead 8*a* and is thus connected to the vehicle ground plane. Lead 17*b* is connected to the positive side of the battery through lead 8*b* and is considered the "hot" or power lead.

The flange 11 and reservoir 13 are connected by a relatively slidable connection to permit adjustment of the overall vertical extent of the module. This slidable connection is not shown in FIG. 1, but is well known in the art. It permits the reservoir 13 to move toward or away from flange 11 for association of the module with fuel tanks of different vertical height.

In the module illustrated, the fuel filter housing 20 and included filter 19 are connected to the flange 11. In other arrangements, the filter housing may be connected to the reservoir 13.

As shown in FIG. 1, the filter housing 20 supports filter 19. Fuel enters the filter housing 20 from hose 23 that is connected to the pump and motor 18. Pressurized fuel passes through the filter 19 and exits the filter through outlet connector 27 for delivery to the engine.

To prevent build-up of electrostatic charge and provide for its dissipation, the lower portion 20*a* of filter housing 20 may be made of conductive polymeric material such as acetal (polyoxymethylene or POM) with a conductive filler. This conductive portion 20*a* of the housing 20 is connected to the vehicle ground plane at lead 17*a* in a well known manner by an insulated metal wire (not shown). Of course, any other form of connection of the conductive portion 20*a* to the electrical circuit ground plane would be acceptable.

The reservoir 13 maintains a level of fuel for supply to the fuel pump and motor 18. It includes an inlet defined by a screen 15 at the bottom of the reservoir maintained in spaced relation to the tank bottom. Fuel enters the inlet 15 from fuel tank 9, usually as a result of the head from the quantity of fuel in the tank 9. When the level of fuel in the fuel tank is low, jet aspiration pump 21 draws, or aspirates, fuel from the fuel tank 9 into the reservoir 13.

After fuel passes through filter 19, it can also exit the housing 20 through hose 25 to pressure regulator 16. The regulator controls pressure of the fuel delivered to the engine through the outlet connector 27 by passing some fuel back to the reservoir 13 when the pressure exceeds a set amount. This is a supply side jet pump system. The invention here, is of course, applicable to systems with return side jet pumps.

Jet aspiration pump 21 includes a body 29 that is hollow and defines a restricted orifice or venturi. The body also defines an inlet 31 open to the fuel in the tank 9 at the reservoir inlet 15, and an outlet 33 open to the reservoir 13.

High pressure fuel in hose 25 is delivered through another hose 35 to the jet orifice 32 which directs flow at high speed to the venture at 90 degrees to the fuel path entering the inlet 19. The flowing fuel aspirates fuel from tank 9 into the inlet 31 of body 29. That fuel is delivered to the reservoir 13 through outlet 33.

Aspirator jet pump 21 is made of conductive polymeric material such as acetal with carbon fibril, or other conductive filler or nylon with a suitable conductive filler. Such conductive material is used to form the body 29 including the venturi and the portions of the body defining inlet 31 and outlet 33. The aspiration jet pump 21 is connected to the ground plane using any suitable means, such as insulated metal wire. Alternatively, the entire reservoir 13 and other module components could be molded of conductive polymeric material to provide a dissipation path for any electrostatic charge that might be generated as a result of fuel flow in the aspiration jet pump 21.

Figure 2:
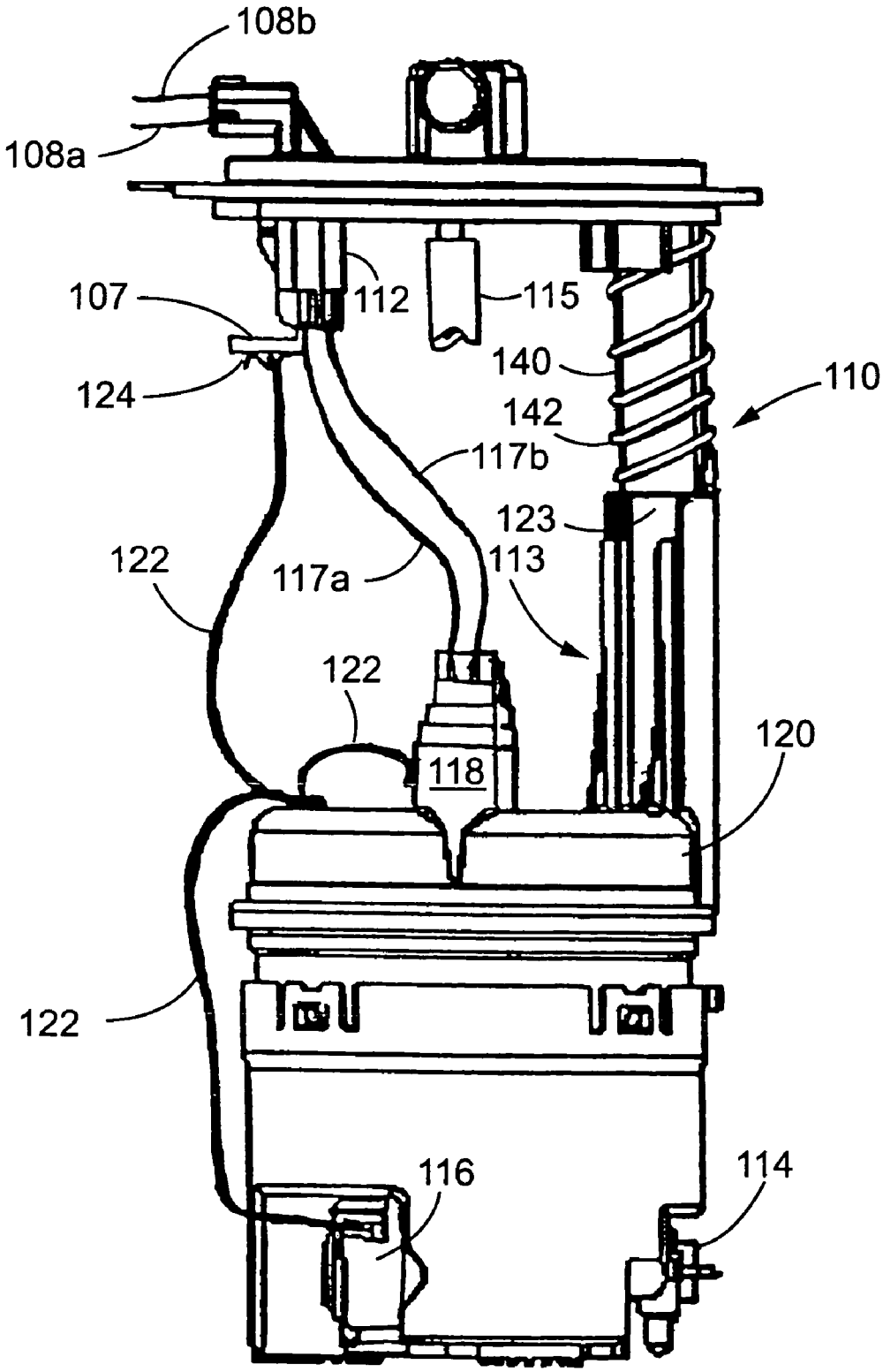
FIG. 2 is a partially broken away front view of another type of in-tank fuel module illustrating details of an embodiment of the present invention.

FIG. 2 shows another form of an in-tank fuel module having a plurality of separate components. The fuel module 110, includes a fuel level sensor assembly 114, a fuel pressure regulator 116, a fuel pump and motor 118 and a fuel filter housing 120 which houses a fuel filter (not shown).

An electrical plug or receptacle 112 is provided for connection to the vehicle electrical system. It includes at least a positive and a negative terminal. Positive and negative leads 117*a* and 117*b* connect to the pump motor 118. The ground terminal lead 117*a* is electrically connected to a grounded portion of a vehicle or other chassis, which is, in turn connected to the negative terminal of the battery through lead 108*a*. Terminal lead 117*b* is connected to the positive side of the circuit through lead 108*b*.

The embodiment of an in-tank fuel module 110 of FIG. 2 includes a flange 111 which as in the embodiment of FIG. 1 mounts the module to a fuel tank. The flange connects to the top wall of the fuel tank and suspends the module 110 within the tank through an entry aperture closed by the flange 111. As in the earlier embodiment, the flange 111 and the reservoir generally designated 113, which carries the other components of the module are connected by a slidable connection to permit adjustment of the overall vertical extent of the module. The slidable connection includes a pair of tubular vertical support tubes 140, one of which is shown in FIG. 2 slidably received in vertical bores within pillars 123 on the reservoir member 113. Each tube 140 is surrounded by a metal wire compression coil spring 142 that urges the flange 111 and reservoir 113 toward the fully extended or elongated condition. When, for example, the reservoir section 113 of a fuel module 110 in any installation contacts the bottom of its associated tank, the springs 142 are compressed to move the flange 111 into its sealed connection with the top wall of the fuel tank.

The flange 111 is usually molded of non-conductive polymeric material such as acetal. The support tubes 140 are metal or a conductive polymer and are conductive. The springs 142 are, of course, also conductive. Thus, the support tubes and springs are a potential location for the build-up of electrostatic charge.

Figure 3:
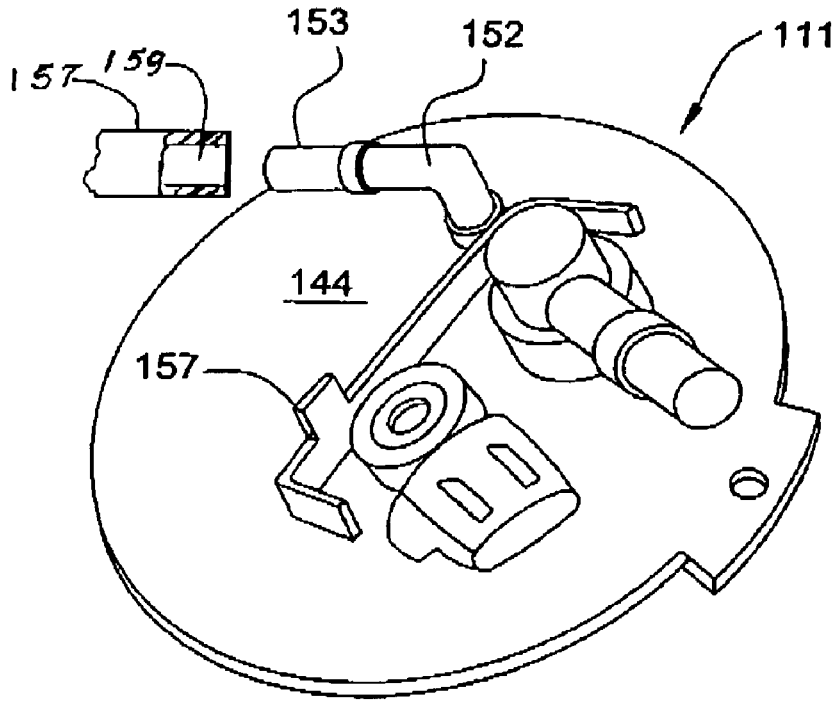
FIG. 3 is a perspective view of the top or exterior of a tank flange of a fuel module embodying the principles of the present invention.
Figure 4:
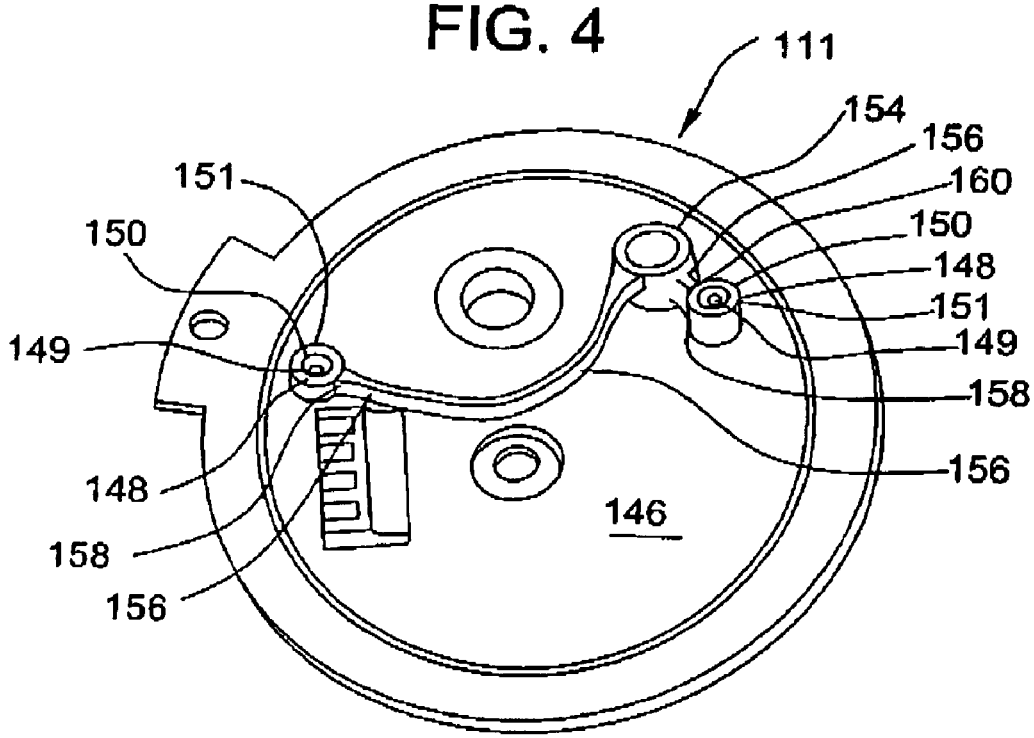
FIG. 4 is a perspective view of the under side or inner surface of a tank flange embodying the principles of the present invention.
Figure 5:
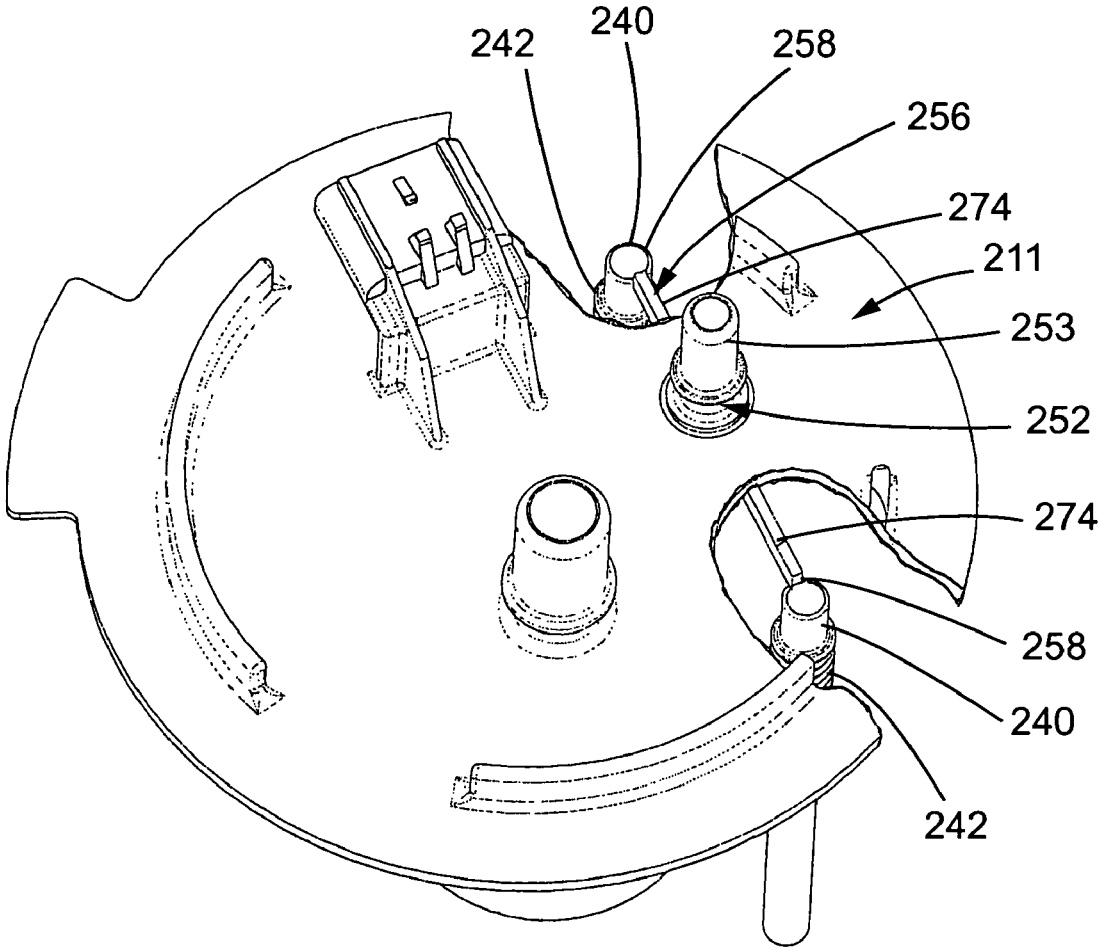
FIG. 5 is a partially broken away perspective top view of a tank flange similar to the tank flanges of FIGS. 3 and 4 embodying the principles of the present invention.

FIGS. 3 and 4 illustrate an arrangement for dissipation of electrostatic charge from the metal support tubes 140 and a metal compression coil springs 142.

A flange 111 is illustrated. FIG. 3 shows the top 144, of the flange external to the fuel tank. FIG. 4 shows the underside or bottom surface 146 that faces downward, or into the tank, when the module is mounted to a tank.

Referring to FIG. 4, the bottom 146 of flange 111 includes a pair of tube posts 148 are molded into the flange. Each of these posts include an internal cylindrical surface 150 defining a bore to receive a support tube 140. The outside diameter of each tube 140 is such that it is frictionally engaged within cylindrical surface 150 of one of the posts 148.

The flange 111 supports a fuel supply port member 152 which includes internal stem 154. It is arranged to receive fuel from module 110 through a flexible hose within the tank. Such a hose is illustrated at 115 in FIG. 2. The hose is conductive and usually formed of a polymeric material filled with conductive material. Port 152 is also conductive and connects to a fuel delivery hose 157 at its stem 153 outside of the fuel tank. The hose connected to stem 153 delivers fuel to the associated consumption component. The hose is usually made of conductive polymeric material, or includes a conductive polymeric layer 159 in contact with stem 153.

The flange 111 includes a conductive web 156 in the form of an overmolded polymeric band. The web or band 156 includes ends 158 that are exposed within the internal cylindrical surface 150 of tube posts 148 and a branch 160 in contact with fuel supply port 152. The ends 158 contact the outer surface of tubes 140 and define a seat 151 to contact the end of spring 142. As illustrated, ends 158 may also include a central pin 149 positioned within the bore defined by cylindrical surface 148. The outer surface of each pin 149 contacts the inner bore of a tube 14 to provide an additional conductive path from the tubes to the web 156.

The web 156 provides a conductive path from posts 148 to the supply port 152. Its ends contact the metal support tubes 140 and connect the tubes 140 and metal springs 142 to the conductive supply port 152. A conductive path is thus provided to dissipate any electrostatic charge that could otherwise accumulate on the support tubes 140 or springs 142 to port 152 and to its associated conductive hose 115 forming part of the fuel module.

The web 156 is an overmolded piece formed of conductive polymeric material that is preferably the same polymer as the non-conductive flange 111. As best seen in FIG. 3, the web includes upstanding feet or "stand offs" 157 that support it in its appropriate position within the mold for injection molding of flange 111. Stabilization of its position is important to the molding process. Since it is made of the same polymer as the flange 111, the material of the web 156 and the flange 111 form a fluid tight relationship during the overmolding process.

Figure 6:
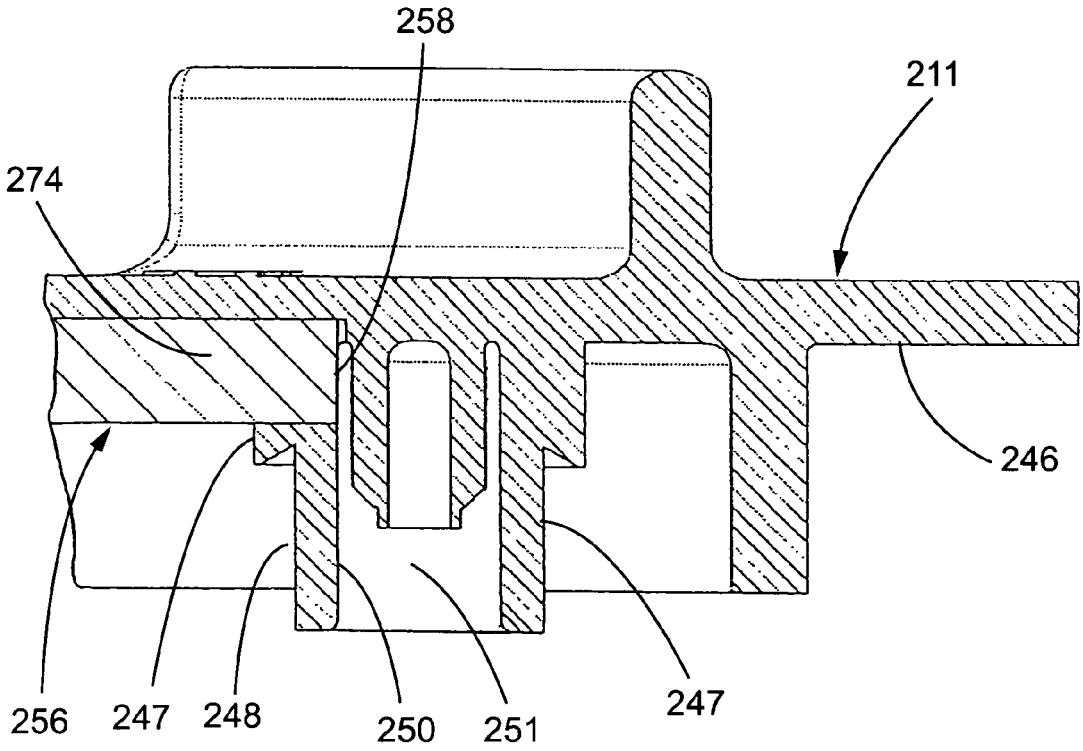
FIG. 6 is a sectional view of the tank flange of FIG. 5 illustrating a tube post prior to insertion of the support tube into the tube post.
Figure 8:
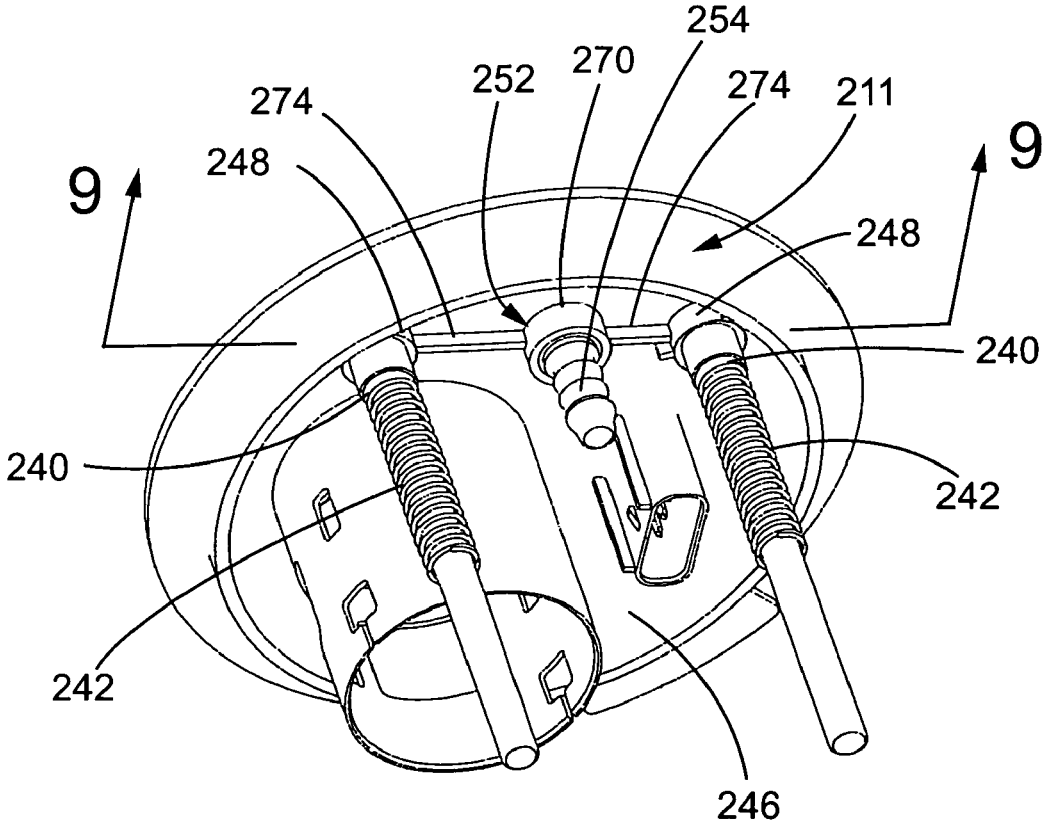
FIG. 8 is a perspective bottom view of the tank flange of FIG. 5 with the integral port and web of FIG. 7 overmolded therein.
Figure 11:
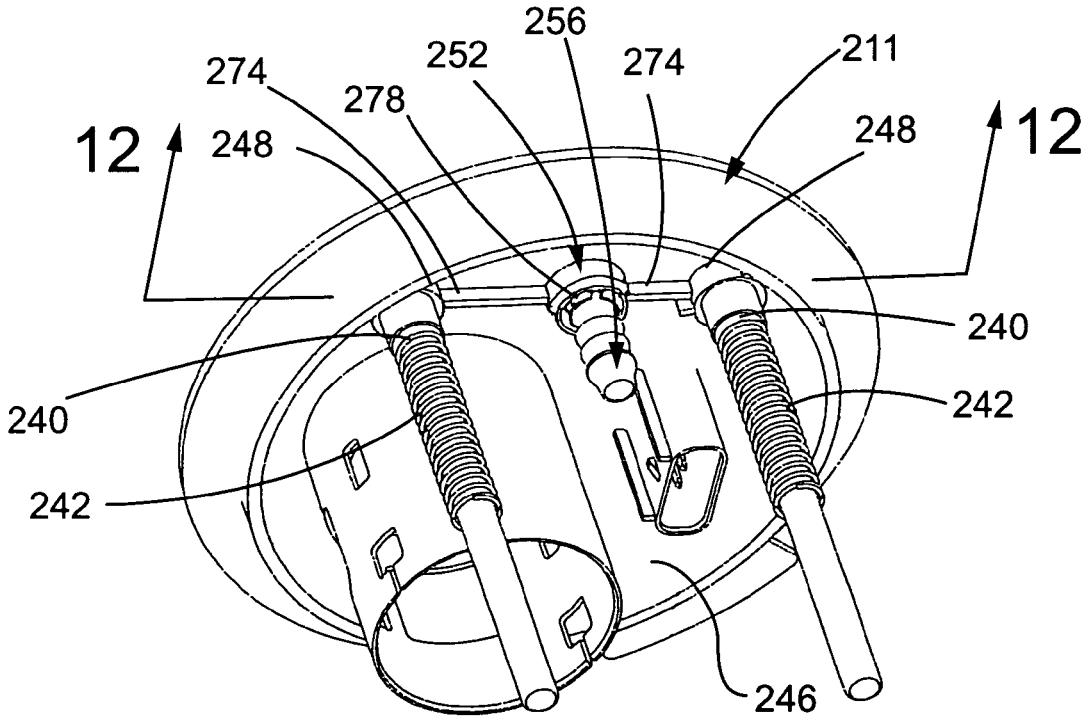
FIG. 11 is a perspective bottom view of the tank flange of FIG. 5 with the web and port assembly of FIG. 10 overmolded therein.

FIGS. 5, 6, 8 and 11 illustrate a tank flange 211, similar to the tank flanges 111 of FIGS. 3 and 4, having a conductive web 256 overmolded therein. The flange 211 is molded of a non-conductive polymer such as acetal. Referring to FIGS. 6, 8 and 11, the bottom 246 of flange 211 includes a pair of tube posts 248 molded in the flange. Each of these posts includes a tubular wall 247 having an internal cylindrical surface 250 defining a bore 251 to receive a support tube 240. The outside diameter of each tube 240 is such that it is frictionally engaged within cylindrical surface 250 of one of the posts 248. The support tubes 240 are made of metal or a conductive polymer. Each support tube 240 is surrounded by a metal wire compression coil spring 242 that urges the flange 211 and a reservoir (not shown) toward a fully extended or elongated condition.

The flange 211 supports a fuel supply port member 252 extending through the flange. The port 252 is mounted to the flange 211 by the web 256. The port 252 is preferably formed of a conductive polymer. The conductive polymer for forming the port 252 can be a mixture of a polymeric material and a conductive filler additive. The polymeric material of the conductive polymer forming the port 252 is preferably acetal. The port 252 includes an external stem 253 adapted to be connected to a fuel hose outside the fuel tank and an internal stem 254 adapted to be connected to a fuel hose inside the fuel tank. The stem may be straight as illustrated, or with a 90° bend as illustrated in FIGS. 3 and 4.

The web 256 and port 252 define a conductive path from the support tubes 240. The web 256 includes laterally extending legs 274 that define ends 258, each contacting a corresponding support tube 240 within tube posts 248 to provide a conductive path from the support tubes 240 to the fuel supply port 252. Any electrostatic charge accumulated on the support tube 240 or spring 242 will dissipate through this path.

Figure 9:
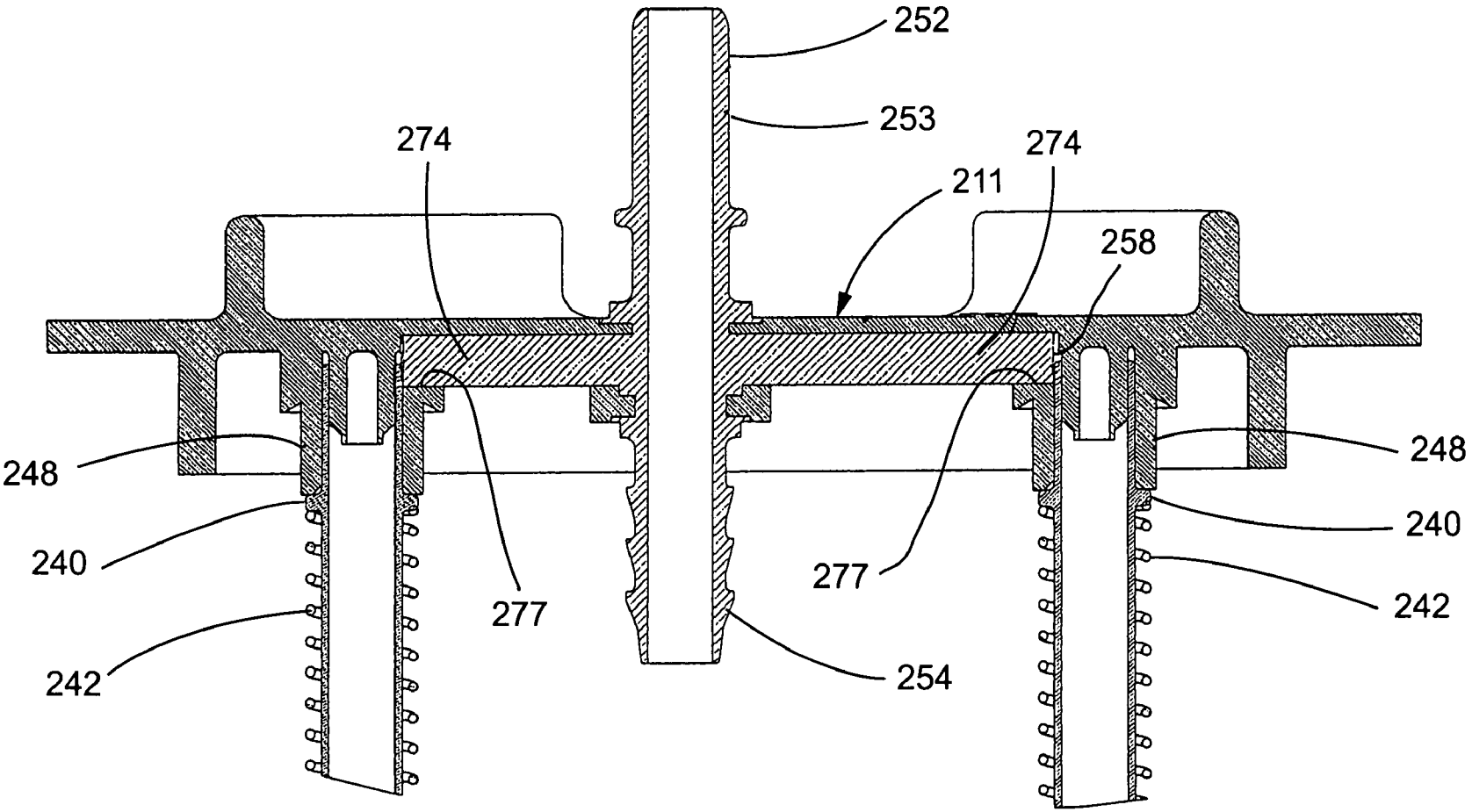
FIG. 9 is a sectional view of the tank flange of FIG. 8 taken along line 9-9 illustrating the principles of the present invention.
Figure 12:
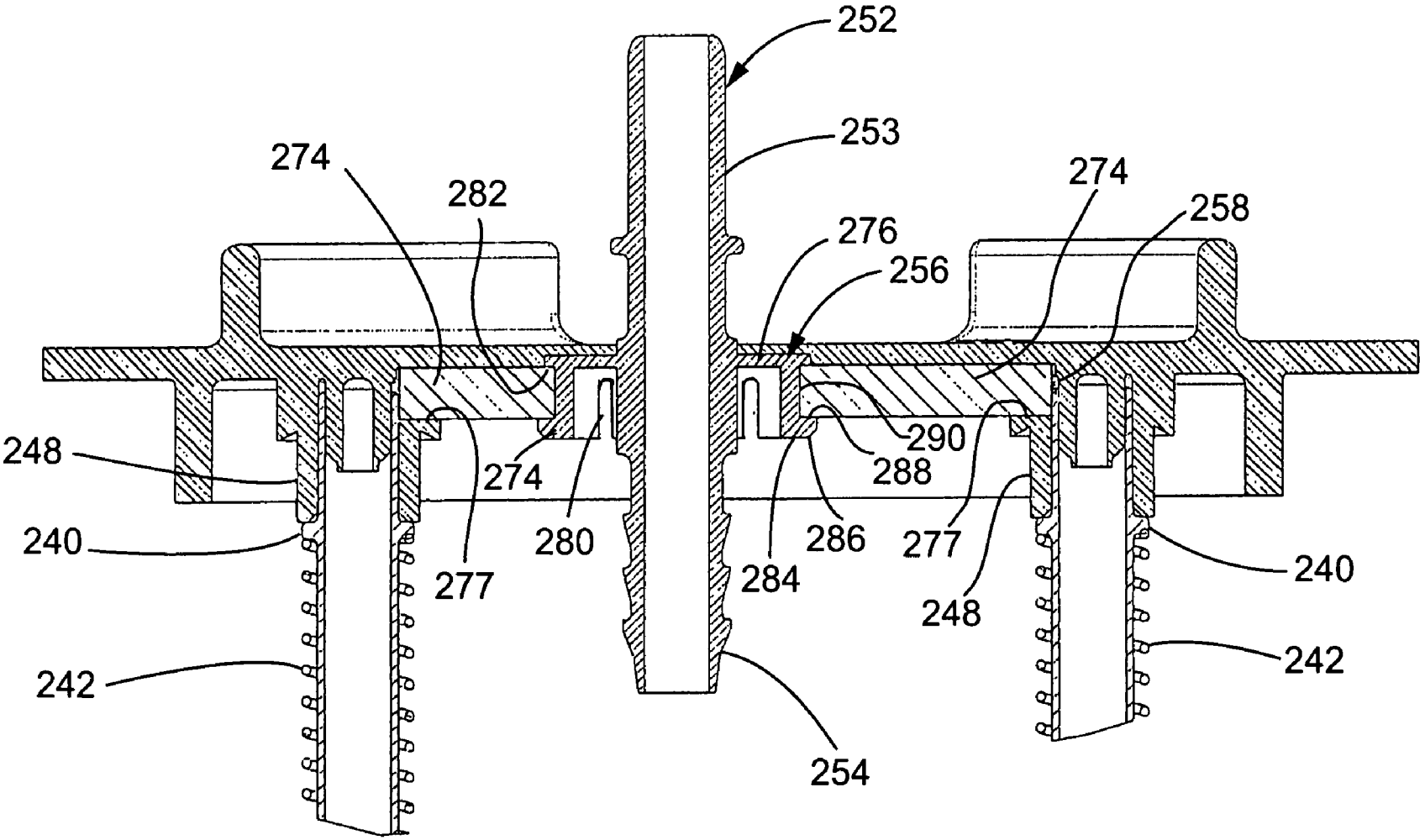
FIG. 12 is a sectional view of the tank flange of FIG. 11 taken along line 12-12 illustrating the principles of the present invention.

As best seen in FIG. 6, each tube post 248 is overmolded around a portion of the leg 274 in a manner as to permit the end 258 of the leg to be exposed in the bore 251 defined in the tube post 248. The leg 274 occupies the space that would have been otherwise occupied by a portion of the tubular wall 247 of the tube post. The exposure of the end 258 of the leg in the bore 251 permits the leg 274 to be in contact with the support tube 240 upon insertion of the support tube into the bore 251. This contacting relation of the ends 258 of the legs 274 with the support tubes 240 is best seen in FIGS. 9 and 12.

The web 256 is preferably formed of a conductive polymer. The conductive polymer for forming the web 256 can be a mixture of a polymeric material and a conductive filler additive. Preferably, the polymeric material of the conductive polymer forming the web 256 is the same polymeric material forming the flange 211. The use of the same polymeric material for forming both the web 256 and the flange 211 assures that the flange bonds to the web to form a fluid tight relationship during the overmolding process. Alternatively, the polymeric material of the conductive polymer forming the web 256 can be different than the polymeric material forming the flange 211, but the two polymeric materials are able to adhere to each other in a fluid tight relation. The use of polymeric materials, capable of adhering to each other, for forming the web 256 and the flange 211, likewise, assures that the flange bonds to the web to form a fluid tight relationship during the overmolding process.

The conductive filler additive of the conductive polymer forming the port 252 and/or the web 256 can be carbon fibers, carbon fibrils, metal particles, or any other conductive material which allows the conductive polymer to form a path to dissipate electrostatic charge.

Figure 7:
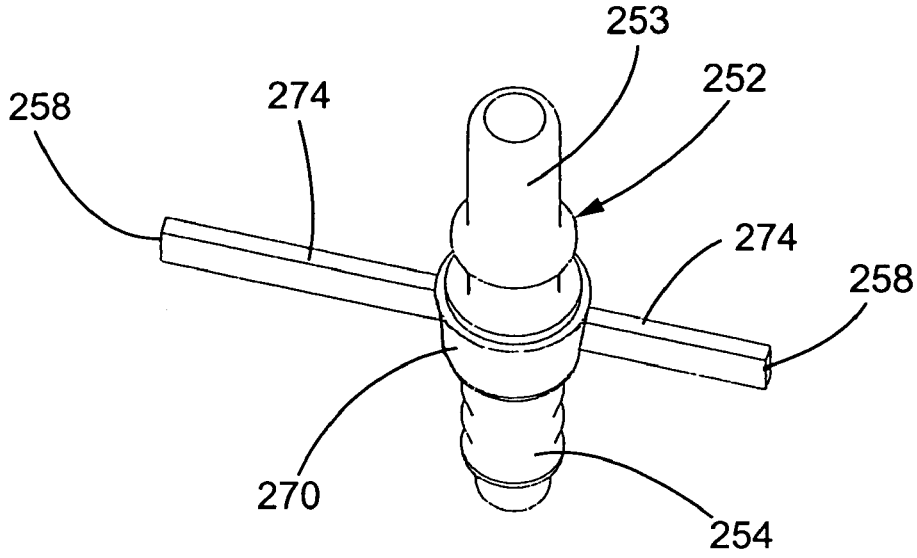
FIG. 7 is a perspective top view of an integral port and web embodying the principles of the present invention.

The conductive web 256 can be formed integral with the port 252 or the conductive web 256 can be formed as a component separate from the port 252 which are then assembled together. An integral web and port component is illustrated in FIGS. 7-9. This component 252 includes an internal stem 253 adapted to be connected to a fuel hose outside the fuel tank, an external stem 254 adapted to be connected to a fuel hose inside the fuel tank, an enlarged diameter cylindrical base 270 and two legs 274 extending outward from the cylindrical base 270. As illustrated in FIGS. 8 and 9, the flange 211 is overmolded around the integral web and port component 252. Each leg 274 of the component 252 defines an end 258. Each end 258 contacts a corresponding support tube 240 to provide a conductive path from the support tubes 240 to the fuel supply port 252 allowing any electrostatic charge accumulated on the support tube 240 or spring 242 to dissipate.

Figure 10:
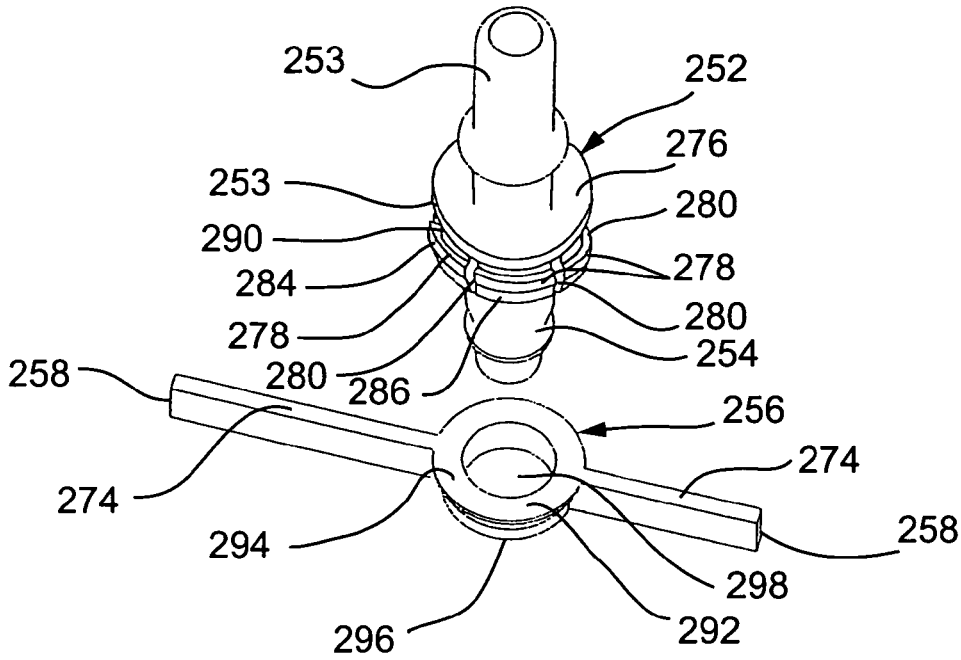
FIG. 10 is a perspective top view of a separate port and a web to receive the port also embodying principles the of the present invention.

FIGS. 10-12 illustrate a conductive web 256 and a separate snap-in port 252 which are assembled together prior to overmolding flange 211. The port 252 includes an exterior stem 253 adapted to be connected to a fuel hose outside the fuel tank, an interior stem 254 adapted to be connected to a fuel hose inside the fuel tank, and a web connecting portion 272. The web connecting portion 272 includes a ring shaped support member 276 and a plurality of fingers 278 extending axially from the support member 276. Slits 280 are defined between the fingers 278 to allow the fingers to flex radially inward. The fingers 278 are located radially inward from the radially outward-most surface of the support member 276 thus defining an annular surface 282 on the underside of the support member radially outward of the fingers 278. Each finger 278 includes a hook 284 having a ramped surface 286 and a ledge 288. A groove 290 is defined between the annular surface 282 of the support member 276 and the ledges 288 of the hooks 284.

The web 256 includes a ring shaped central body 292 and two legs 274 extending outward from the central body. Each leg 274 defines an end 258. The central body 292 has an annular upper surface 294 and an annular lower surface 296. The central body defines a central hole 298 extending through the central body 292 from the upper surface 294 to the lower surface 296. The central hole 298 of the conductive web 256 receives the snap-in port 252.

The web 256 and the port 252 are assembled by inserting the internal stem 254 of the port 252 through the hole 298 defined in the central body 292 until the ramped surfaces 286 of the fingers 278 contact the central body 292. Further effort to insert the port 252 through the hole 298 causes the central body 292 to create a radially inward force on the ramped surfaces 286 forcing the fingers 278 to flex radially inward. Once the ledges 288 of the hooks 284 surpass the central body 292, the fingers 278 snap radially outward such that the central body 292 is situated in the groove 290 defined on the web retaining portion 272. With the central body 292 situated in the groove 290, the upper surface 294 of the central body 292 is in abutting relationship with the annular surface 282 of the support member 276 and the lower surface 296 of the central body 292 is in abutting relationship with the ledges 288 of the fingers 278, thus preventing any axial movement of the port 252 relative to the web 256.

With the web 256 and the port 252 assembled as a unitary assembly, the flange 211 is overmolded around the unitary assembly as in the earlier embodiment shown in FIGS. 7 to 9, each end 258 of the legs 274 of web 252 contacts a corresponding support tube 240 to provide a conductive path from the support tubes 240 to the fuel supply port 252 allowing any electrostatic charge accumulated on the support tube 240 or spring 242 to dissipate.

The illustrated embodiment discloses overmolding the flange 211 around the unitary assembly of a web 256 and port 252 after the web 256 and the port 252 were assembled. It remains within the spirit of the present invention to first overmold the flange around a web, similar to the web 252, and then assemble the port with the web by inserting the port into the hole of the web in the manner described above.

Figure 13:
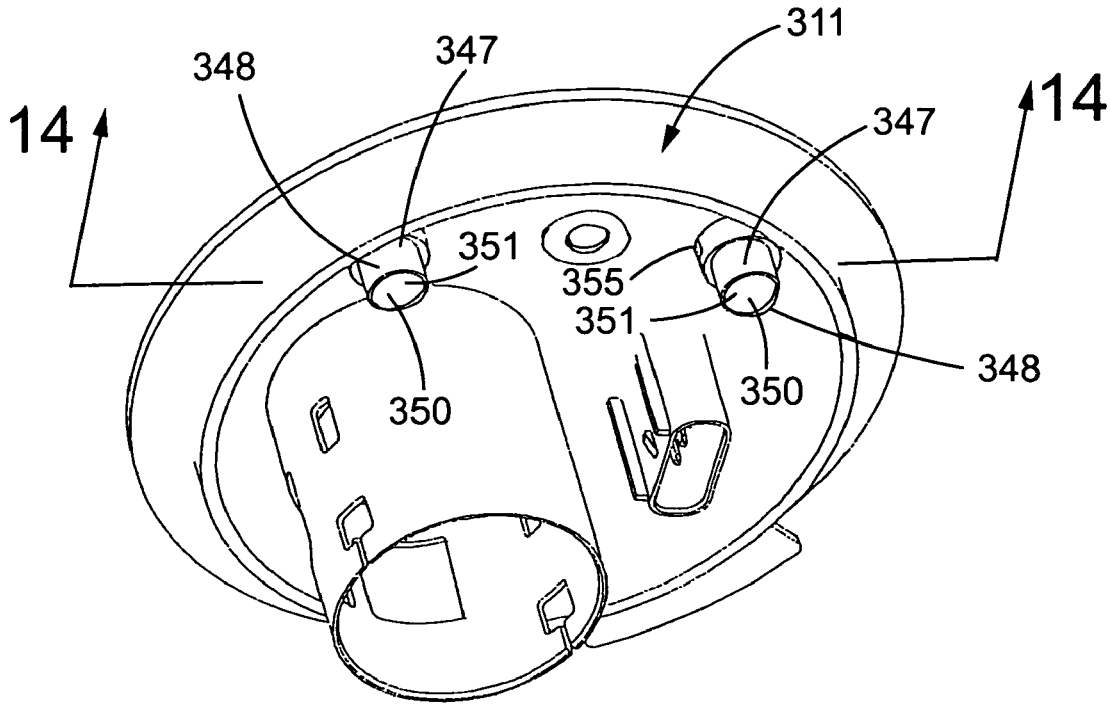
FIG. 13 is a perspective bottom view of a tank flange embodying the principles of the present invention.
Figure 14:
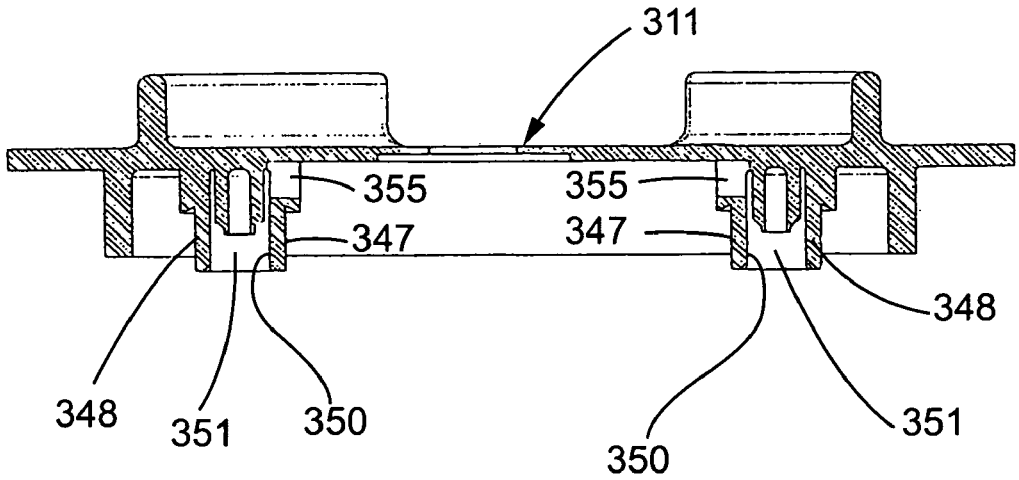
FIG. 14 is a sectional view of the tank flange of FIG. 13 taken along line 14-14 illustrating the principles of the present invention.

FIGS. 13 and 14 illustrate a tank flange 311 similar to the tank flange 211 illustrated in FIGS. 5, 6, 8 and 11 with the exception that the tank flange 311 is formed to receive a conductive web, similar to the web 256, after the flange 311 has been molded, rather than overmolding the flange with the web therein. The flange 311 is molded of a non-conductive polymer such as acetal. The flange 311 includes a pair of tube posts 348 molded in the flange. Each of the posts 348 includes a tubular wall 347 having an internal cylindrical surface 350 defining a bore 351 to receive a support tube. The cylindrical surface 350 defining the bore 351 is sized such that the support tube is frictionally engaged within the cylindrical surface 350. The wall 347 of each post 348 further defines a notch or void 355 extending from the outer surface of the post to the bore 351. Each notch 355 is adapted to receive a portion of a leg of the conductive web. Insertion of a portion of a leg through the notch 355 exposes the end of the leg to the bore 351 and permits the end of leg to be in contact with the support tube upon the support tube inserted into the bore.

Various features of the present invention have been described with reference to the above embodiments. It should be understood that modification may be made without departing from the spirit and scope of the invention.

I claim:

1. A fuel module comprising:

a non-conductive flange connecting said fuel module to a fuel tank, said flange formed of a polymeric material;

a conductive fuel supply port mounted to said flange including a portion connected to ground outside said tank;

a conductive support tube mounted to said flange; and a conductive web in conductive contact with said fuel supply port and said support tube.

2. The fuel module of claim 1 further including a conductive hose connected to said fuel supply port outside the tank.

3. The fuel module of claim 1 wherein 1 said conductive web is formed of a conductive polymer and said polymeric material forming said flange is acetal,

4. The fuel module of claim 2 wherein said polymeric material forming said flange is acetal,

5. The fuel module of claim 1 wherein said flange is overmolded around said web.

6. The fuel module of claim 2 wherein said conductive polymer forming said web is a polymeric material mixed with a conductive filler.

7. The fuel module of claim 6 wherein said polymeric material of said conductive polymer forming said web is acetal.

8. The fuel module of claim 6 wherein said polymeric material of said conductive polymer forming said web is the same polymeric material forming said flange.

9. The fuel module of claim 6 wherein said conductive filler additive of said conductive polymer forming said web is carbon fiber.

10. The fuel module of claim 6 wherein said conductive filler additive of said conductive polymer forming said web is carbon fibrils.

11. The fuel module of claim 1 wherein said conductive support tube is made of metal.

12. The fuel module of claim 1 wherein said conductive support tube is formed of a conductive polymer.

13. The fuel module of claim 1 further comprises a metal coil spring surrounding said support tube, said conductive web is in conductive contact with said coil spring.

14. The fuel module of claim 1 further comprises a second conductive support tube attached to said flange.

15. The fuel module of claim 14 wherein said second conductive support tube is made of metal.

16. The fuel module of claim 14 wherein said second conductive support tube is formed of a conductive polymer.

17. The fuel module of claim 14 further comprises a metal coil spring surrounding said second support tube, said conductive web is in conductive contact with said coil spring.

18. The fuel module of claim 1 wherein said conductive fuel supply port is formed of a conductive polymer.

19. A fuel module comprising:

a flange adapted to connect said fuel module to a fuel tank, said flange formed of a polymeric material;

a conductive fuel supply port mounted to said flange;

a conductive support tube mounted to said flange; and a conductive web in conductive contact with said fuel supply port and said support tube wherein said conductive web is integral with said port.

20. The fuel module of claim 19 wherein said port includes a cylindrical base and two legs extending outward from the cylindrical base.

21. The fuel module of claim 19 wherein said conductive web is formed separate from said port.

22. The fuel module of claim 21 wherein said conductive web defines a hole for receiving said port.

23. The fuel module of claim 21 wherein said conductive web includes a central body, said hole for receiving said port is defined in said central body.

24. The fuel module of claim 23 wherein said central body is ring shaped.

25. The fuel module of claim 23 wherein said conductive web further includes two legs extending outward from said central body.

26. The fuel module of claim 22 wherein said port includes a plurality of fingers adapted to secure said port to said web.

27. The fuel module of claim 22 wherein said port snaps into said hole defined in said conductive web.

28. A fuel module comprising:

a flange adapted to connect said fuel module to a fuel tank, said flange formed of a polymeric material;

a conductive fuel supply port mounted to said flange;

a conductive support tube mounted to said flange; and a conductive web in conductive contact with said fuel supply port and said support tube wherein said flange includes a tube post defining a bore, said conductive support tube is inserted in said bore of said tube post and wherein said web defines at least one end, said at least one end of said web is exposed in said bore of said tube post for contact with said conductive support tube inserted in said bore of said tube post.

29. The fuel module of claim 28 wherein said tube post includes a wall having an internal cylindrical surface defining said bore.

30. The fuel module of claim 29 wherein said wall is a tubular shaped wall.

31. The fuel module of claim 29 wherein said at least one end of said web extends through said wall of said post.

32. The fuel module of claim 29 wherein said wall is overmolded around the portion of said web extending through said wall.

33. The fuel module of claim 32 wherein said wall defines a notch extending therethrough for receiving said web.

34. The fuel module of claim 28 wherein said flange includes a second tube post defining a bore, a second conductive support tube is inserted in said bore of said second tube post, said web defines a second end, said second end of said web is exposed in said bore of said second tube post for contact with said second conductive support tube inserted in said bore of second tube post.

* * * * *